United States Patent [19]

Christison

[11] Patent Number: 4,928,925

[45] Date of Patent: May 29, 1990

[54] CONSTANT TENSION HOISTING MEMBER

[76] Inventor: S. Grant Christison, 723 Sudden Valley, Bellingham, Wash. 98226

[21] Appl. No.: 847,496

[22] Filed: Apr. 2, 1986

Related U.S. Application Data

[63] Continuation of Ser. No. 653,942, Sep. 20, 1984, Pat. No. 4,624,450.

[51] Int. Cl.[5] ..... B66D 1/52; B66D 1/08

[52] U.S. Cl. ..... 254/272; 254/264; 254/344; 254/361; 254/900

[58] Field of Search ..... 254/270, 272, 273, 340, 254/344, 361, 900; 414/139, 138

[56] References Cited

U.S. PATENT DOCUMENTS

| | | | |
|---|---|---|---|
| 1,275,399 | 8/1918 | Crooks | 114/368 |
| 1,468,038 | 9/1923 | Sieurin | 114/368 |
| 2,178,305 | 10/1939 | Smaltz | 254/900 X |
| 2,293,936 | 8/1942 | Crooke | 254/273 |
| 2,402,789 | 6/1946 | Tweedale | 254/361 X |
| 2,698,949 | 1/1955 | Miller | 254/272 X |
| 4,034,963 | 7/1977 | Warman | 254/273 |
| 4,118,012 | 10/1978 | Kerr | 414/138 X |
| 4,121,293 | 10/1978 | Kerr | 254/267 |
| 4,132,387 | 1/1979 | Somerville | 414/139 X |
| 4,304,337 | 12/1981 | Dummer | 414/139 X |
| 4,312,497 | 1/1982 | Whaley | 254/344 |
| 4,434,972 | 3/1984 | Charles | 254/340 |
| 4,624,450 | 11/1986 | Christison | 254/273 |

FOREIGN PATENT DOCUMENTS

| | | | |
|---|---|---|---|
| 203663 | 9/1956 | Australia | 254/266 |
| 1112476 | 8/1961 | Fed. Rep. of Germany . | |

*Primary Examiner*—Katherine Matecki

[57] ABSTRACT

A constant tension hoisting system is provided for raising and lowering an object between a platform and a surface undergoing vertical motion relative to the platform, such as raising and lowering a lifeboat from a seagoing vessel to the sea in rough weather. The system operates in a normal hoisting mode to raise or lower the object, and in a constant tension mode when the object is supported on the surface. The system is changed from the normal hoisting mode to the constant tension mode at the moment when the object being lowered is first supported by the surface, and a slack condition exists in the cable. The changeover from the normal hoisting mode to the constant tension mode, is performed by a solenoid-operated mode selector responsive to a proximity switch operated by a lever arm engaging the cable. The hoisting system is operated by a single, manually-actuated control lever, which mechanically activates the proximity-type control switches. An auxiliary motor connected to a ring gear of a planetary-type final drive operates the hoisting system in the constant tension mode, while a main motor operates the system in the normal hoisting mode.

8 Claims, 3 Drawing Sheets

FIG. 4
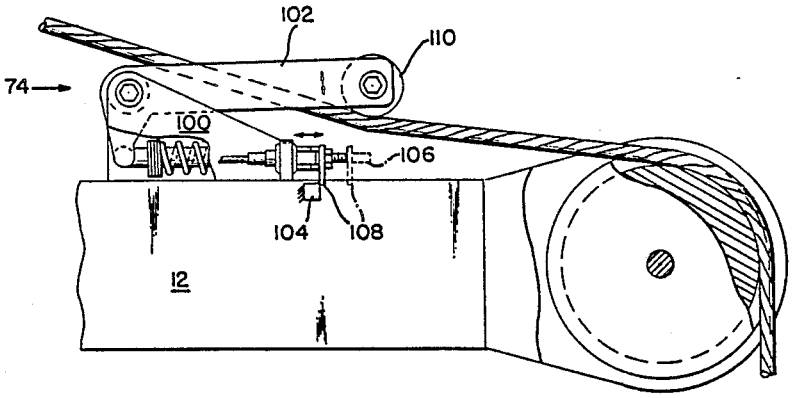
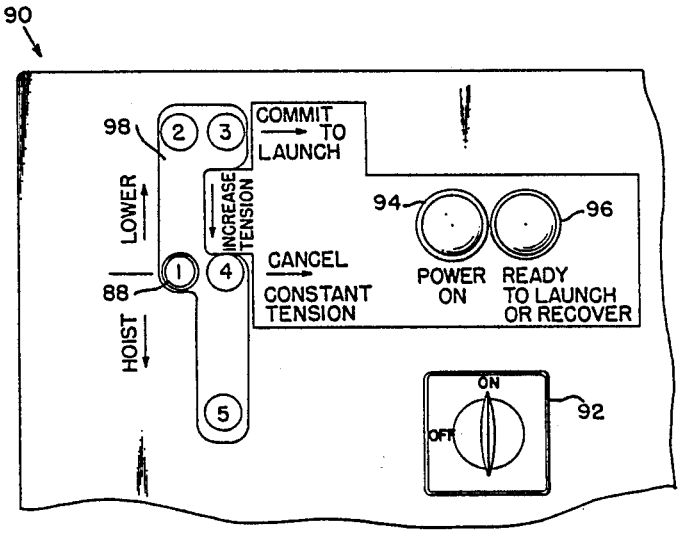
FIG. 3

CONSTANT TENSION HOISTING MEMBER

This application is a continuation of U.S. patent application Ser. No. 653,942, filed Sept. 20, 1984 now U.S. Pat. No. 4,624,450, issued Nov. 25, 1986.

TECHNICAL FIELD

This invention pertains to automatic controls for hoisting devices, and more particularly to devices for raising and lowering an object, such as a lifeboat, from a platform such as a sea-going vessel to a surface, such as the sea, undergoing vertical motion relative to the platform, as in rough weather with high waves.

BACKGROUND ART

Many hoisting devices for raising or lowering an object between a platform and a vertically moving surface have recognized the need to prevent the occurrence of slack in the hoisting cable. If slack is allowed to develop in the cable, the motion of the object as it rests on the moving surface will cause a violent jerk as the slack is taken up. This jerk may cause undue stresses to the hoisting cable and supporting structure, damage the hoisting connections of the object and the hoisting device, or discomfort to passengers in the object if a lifeboat.

Prior art devices as in U.S. Pat. Nos. 2,402,784 and 2,178,305 are attempts to prevent the occurrence of slack immediately prior to raising the object from the surface to the platform by creating a constant tension condition in the cable. U.S. Pat. No. 2,178,305 further switches from this constant tension mode to a hoisting mode at an optimum point in the waveform of the moving surface. These devices are expensive and complicated and are not well suited to lowering an object from the platform to the moving surface.

DISCLOSURE OF INVENTION

It is an object of this invention to provide a hoisting system for lowering an object from a platform to a surface moving vertically relative to the platform, where the hoisting system is capable of automatically switching between a normal hoisting mode and a constant tension mode when the object is supported on the water.

It is another object of this invention to provide a single-lever, manually-actuated control lever by which a hoisting system is operated both in the normal hoisting mode and the constant-tension mode.

These and other objects are obtained by providing a constant tension hoisting system for raising and lowering an object between a platform and a surface undergoing vertical motion relative to the platform, for example, to raise and lower a lifeboat between a seagoing vessel and the sea during heavy wave action. The hoisting system is capable of operation in either a normal hoisting mode or a constant tension mode, and is capable of automatically switching from the normal hoisting mode to the constant tension mode when the object is first supported on the surface and a slack condition exists in a cable from which the object is suspended.

The hoisting system comprises the cable by which the object is suspended, a drum for reeling in and paying out the cable, a main drive for operating the drum when the system is in the normal hoisting mode and an auxiliary drive for operating the drum when the system is in the constant tension mode, a final drive for connecting the main drive and the auxiliary drive to the drum, a tension sensor for sensing the tension in the cable, and a mode selector responsive to the tension sensor for switching the system from the normal hoisting mode in the lowering direction to the constant tension mode when a substantially slack condition exists in the cable.

The tension sensor includes a proximity-type switch normally held in the open position by a spring, a lever arm capable of rotation about a pivot pin, a roller positioned at a free end of the lever arm for engaging the cable, and a switch actuating plate for operating the proximity switch of the tension sensor.

The mode selector includes a single, manually actuated control lever, two proximity-type switches actuated by the control lever, and three electrical relays and a solenoid-actuated valve responsive to the proximity switches of the mode selector and the tension sensor.

The hoisting system further includes a control box having a control panel comprising one surface of the control box, a control lever slot comprising an opening in the control panel, and the control lever of the mode selector, which extends from an interior portion of the control box through the slot in the control panel. The slot allows the control lever to be placed in five lever positions. The first lever position corresponds to a neutral position when the system is in the hoisting mode, neither raising nor lowering the object. In the constant tension mode the first lever position causes maximum tension to be maintained in the cable. The second lever position causes the object to be lowered when the system is in the hoisting mode and causes the system to maintain minimum or no tension in the cable when the system is in the constant tension mode. The third lever position activates the mode selector, allowing the mode selector to change the system from the normal hoisting mode to the constant tension mode at the moment when a slack condition first exists in the cable. The fourth lever position causes the mode selector to change the system from the constant tension mode to the normal hoisting mode. The fifth lever position causes the system to raise the object in the normal hoisting mode.

The control lever cannot be moved from the first lever position to the fifth lever position without passing through and being placed in the fourth lever position. Similarly, the control lever cannot be moved from the first lever position to the third lever position without passing through and being placed in the second lever position.

The final drive is a planetary-type gear set having a sun gear, a planet gear and a ring gear. The planet gear is held in position by a planet gear cage which is connected to the cable drum The sun gear is directly connected to the main drive. The ring gear is connected to the auxiliary drive by an auxiliary gear engaging gear teeth around an exterior surface of the ring gear. A brake controls the rotation of the ring gear. The brake is hydraulically actuated, and the hydraulic pressure required to release the brake and allow rotation of the ring gear is greater than the hydraulic pressure required to operate an auxiliary motor of the auxiliary drive.

When lowering an object from the platform to the water, the hoisting system is first operated in the normal hoisting mode to lower the object toward the surface. The hoisting system is then changed from the normal hoisting mode to the constant tension mode at the moment when the object is first supported on the surface, creating a substantially slack condition in the cable by which the object was suspended.

BRIEF DESCRIPTION OF THE DRAWINGS

FIG. 3 is a plan view of the main control of the embodiment of FIG. 2, showing the positions of the control lever.

FIG. 4 is a side view of the tension sensing means of the embodiment of FIG. 2, showing the cable engaging means and proximity switch.

BEST MODE FOR CARRYING OUT THE INVENTION

Figure 1:
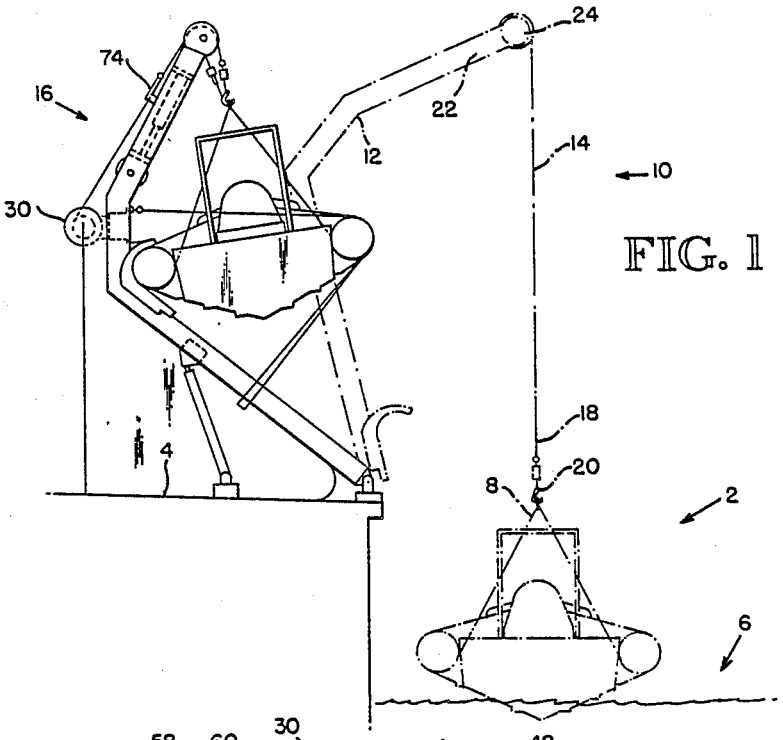
FIG. 1 is a side view of an object being lowered from a platform onto a surface undergoing vertical motion relative to the platform, as in rough seas.

As shown in FIG. 1, an object 2, such as a lifeboat, floatplane or the like, being raised or lowered between a platform 4, such as a floating vessel, and a surface undergoing vertical motion relative to the platform, such as the sea 6 in rough weather, is typically suspended over the surface on a lifting harness 8 using a crane or davit assembly 10. The davit assembly comprises a davit or boom 12, a cable 14 and a hoisting system 16.

An outboard end 18 of the cable 14 is removably attached to the lifting harness 8 of the object by a hook 20. The cable extends upwardly from the end 18 to the outer end 22 of the davit 12, where it passes over a sheave 24. The cable continues from sheave 24 to a drum 30 of the hoisting system 16. The hoisting system 16 is mounted on a frame 26 which is attached to the platform 4.

When the lifeboat 2 is suspended by the davit assembly 10, and the hoisting system supports the entire weight of the lifeboat, the hoisting system 16 is in a normal hoisting mode. During the transitions between the hoisting mode and the period when the lifeboat is supported entirely by the water, immediately after the lifeboat has been lowered from the platform 4 onto the water or immediately before the lifeboat is to be raised from the water to the platform, the hoisting system 16 is placed in a constant tension mode. In the constant tension mode, the hoisting system operates to maintain a relatively constant tension in the cable by paying out and reeling in the cable as the lifeboat rises and falls on the moving water, maintaining a tension in the cable. As is well known in constant tension hoisting systems, the tension maintained by the winch may be set at a predetermined constant tension, but that constant tension setting may be varied or shifted according to the tension desired to be maintained.

Figure 2:
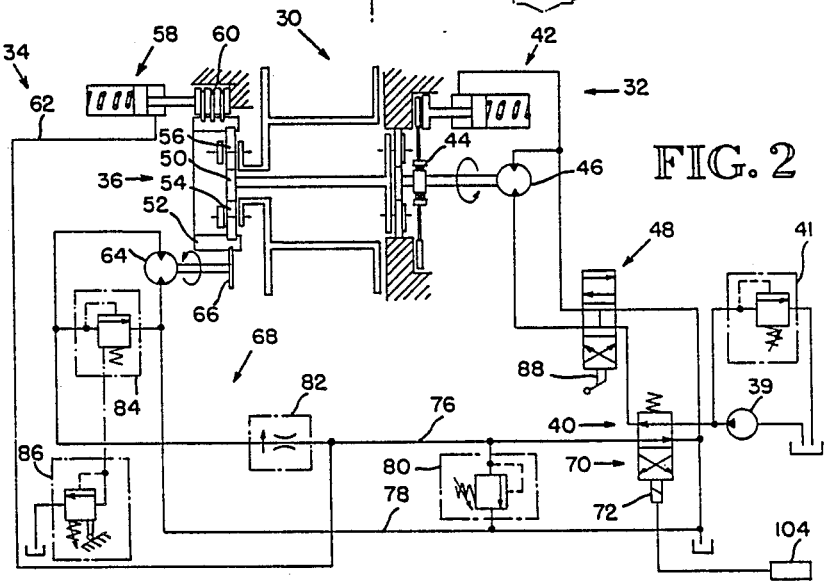
FIG. 2 is a schematic representation of the preferred embodiment of the invention, showing the relations of the main and auxiliary motors, the planetary drive, the cable and drum, and their controls.

As best seen in FIG. 2, the hoisting system 16 comprises the drum 30, a main drive 32 having a planetary final drive assembly 36, a constant tension drive 34 forming part of the final drive assembly, a conventional hydraulic pump assembly 38 and a mode selection system 40. The hydraulic pump assembly 38 comprises a hydraulic pump 39 and a main system relief valve 41.

The main drive 32 is conventional and comprises a primary brake assembly 42, a one-way clutch 44, a main motor 46, and a manual control valve 48. The main pressure relief valve 41 may be fabricated as part of the control valve 48, provided that the mode selector 40 is designed to never completely prevent the flow of hydraulic fluid while the mode selector system 40 is actuated.

The manual control valve 48 connects the pump to the motor either to hoist or lower mode, neutral in which the motor is stopped and the load is held by the brake 42.

The planetary drive assembly 36 comprises the sun gear 50, an internal ring gear 52, planet gears 54, a planet cage 56, and a final drive brake 58. The sun gear 50 is positioned coaxial with and fixedly attached to a drive shaft of the main drive. The planet cage 56 is fixed to the drum.

The brake 58 is spring operated to engage brake discs 60 to lock the ring gear 52 to the winch housing. The brake is hydraulically disengaged by fluid entering through a brake operating line 62.

When the hoisting system 16 is in the manual hoisting mode, no pressure is applied to the brake 58 When the hoisting system 16 is in the constant tension mode, the internal ring gear 52 is allowed to rotate, the sun gear 50 is held stationary by the primary brake assembly 42, and the cable 14 is paid out and reeled in by the constant tension drive 34.

The constant tension drive 34 comprises a hydraulic auxiliary motor 64, an auxiliary gear 66, and a constant tension fluid control system 68. The motor 64 is a conventional, reversible hydraulic motor capable of rotating at relatively high speed. The auxiliary gear 66 has gear teeth that mesh with corresponding gear teeth around the exterior circumference of the internal ring gear 52.

It is an important feature of this invention to automatically switch between normal and constant-tension modes of operation. For this purpose the mode selection system 40 comprises a solenoid operated mode selection valve 70, controlled by a solenoid 72, and a cable tension sensor 74. The mode selection valve is actuated by a solenoid energized responsive to a signal from the cable tension sensor 74. When the hoisting system 16 is in the normal hoisting mode, solenoid 72 is de-energized, placing the mode selection valve 70 in a normal hoisting mode where fluid from the hydraulic pump assembly 38 is allowed to flow to the main drive 32, and prevented from flowing to the constant-tension drive 34. When the hoisting system 16 is in the constant tension mode, the mode selection valve 70 is shifted upwardly as viewed in FIG. 2 by the solenoid and fluid is allowed to flow to the constant-tension drive 34, and prevented from flowing to the main drive.

The constant-tension fluid control system 68 comprises a fluid supply line 76, a return line 78, a pressure relief valve 80, a flow control valve 82, a pilot-operated pressure relief valve 84, a cam operated relief valve 86, and the brake operating line 62.

The pressure relief valve 80 operates to maintain a relatively high pressure (approximately 100 psi higher than valve 84) in line 76. The brake operating line 62 connects the line 76 to the final drive brake such that the brake 58 is released whenever the line 76 is pressurized. The extra volume of fluid that does not pass through the motor 64 flows through relief valve 84 to the return line 78. The relief valve 84 performs a dual function. When the hoisting system 16 is in the constant tension mode and the motor 64 is reeling in the cable 14, the valve 84 ensures that fluid at a desired pressure is available to the constant tension motor. When the load rides down on a wave trough, the drum lets out the cable 14 in the constant tension mode and the motor 64 is driven as a hydraulic pump. In this situation, the relief valve 84 determines the resistance to the fluid flow through the motor 64. The valve 84 is large enough to carry the flow supplied by valve 82 and the pumping action of motor 64 in the drum lowering constant-tension condition. Furthermore the valve 84 is mounted directly on the motor 64 to minimize hydraulic friction losses. The level of pressure maintained by the relief valve 84 is set by the cam operated relief valve 86, which is cam-actuated by a main motor control lever 88.

Referring to FIG. 3, a control box 90 contains the control lever 88, a power switch 92, a power-on light 94, and a ready-to-launch or recover light 96. The manual control valve 48 may be in the control box 90, or external to the control box 90 and operated remotely by a mechanical linkage such as a conventional push-pull cable. The control lever 88 is guided in a lever slot 98 in the control box.

The slot 98 allows the control lever to be in one of five lever positions: 1, 2, 3, 4, and 5. The lever positions 1 and 4 correspond to neutral positions. Placement of the control lever 88 in the lever position 5 places the normal hoist manual control valve 48 in the hoist position to raise the lifeboat or other objects. Placement of the control lever 88 in position 2 when the hoisting system 16 is in the normal hoisting mode places the manual control 48 in the lowering position, allowing the drum 30 to lower the lifeboat. Placement of the control lever in position 3 causes the control lever 88 to engage a conventional control box proximity-type commit-to-launch switch 114, closing a circuit to the cable tension sensor switch 104 which enables the energization of the solenoid 72 when the switch 104 gets closed. Closing of switch 104 results in the mode selector 40 placing the hoisting system 16 in the constant tension mode. The ready-to-launch or recover light 96 will also be energized. Placement of the control lever in position 4 de-energizes a conventional proximity-type cancel switch 112 which, when the system is in the constant tension mode, causes the mode selector 48 to change the hoisting system 16 to the normal hoisting mode. The slot 98 is designed such that lever position 5 for normal hoisting cannot be reached without passing through lever position 4, causing the hoisting system 16 to enter the normal hoisting mode and cancel the constant tension mode.

As best seen in FIG. 4, the cable tension sensor 74 comprises a mounting bracket 100 fixed to the davit 12, and a lever arm 102 pivotally mounted on the bracket. The cable tension sensor switch is a normally open proximity-type switch 104. An operating rod 106 is fixed to a switch actuator plate 108.

The lever arm 102 is spring biased downwardly or clockwise in FIG. 4. A roller 110 is attached to the free end of the lever arm to engage the cable. The switch operating rod 106 is connected to the other end of the lever arm 102. When the cable 14 is under tension or taut, the cable is stretched between the roller 24 of the davit 12 and the hoisting system 16, the lever arm 102 is pivoted counterclockwise to move the plate 108 away from switch 104 to open the switch.

Figure 5:
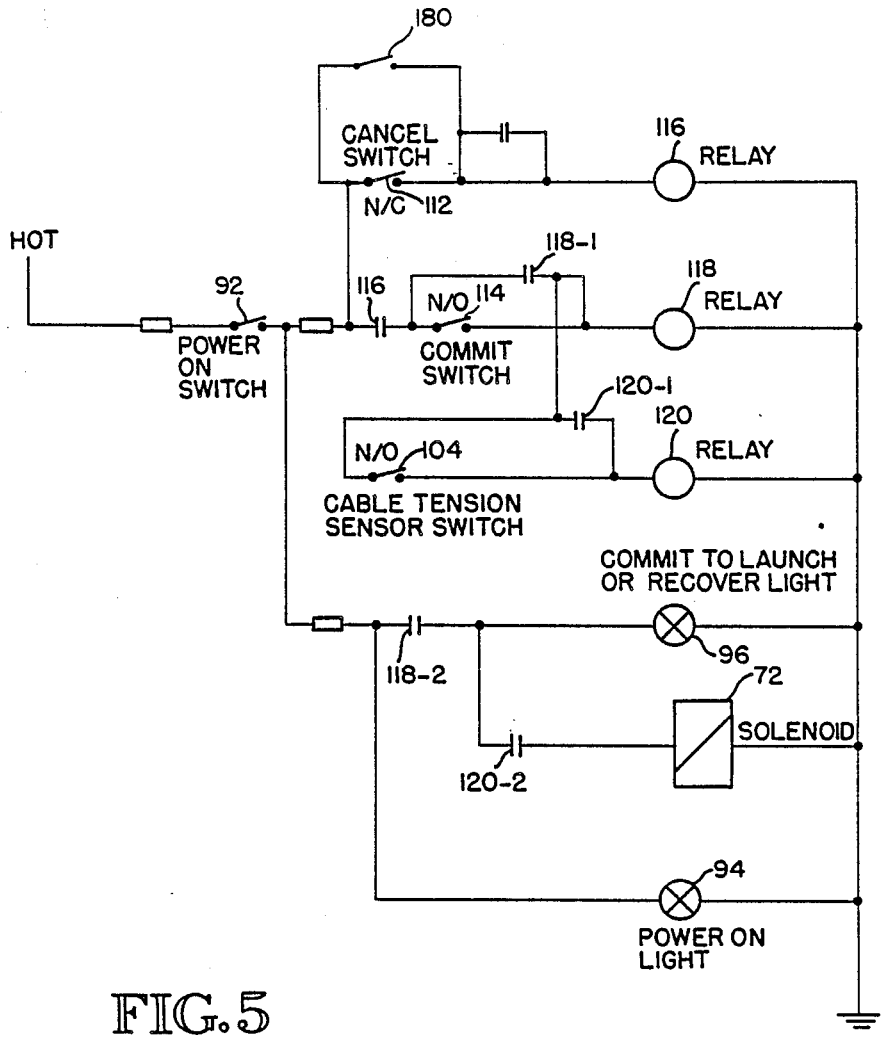
FIG. 5 is an electrical schematic diagram of the mode selector of the embodiment of FIG. 2, showing the proximity switches and electrical relays.

As best seen in FIG. 5, the electrical circuit of the control box comprises the power-on switch 92, pilot lights 94, 96, cancel switch 112, commit switch 114, and three electrical relays 116, 118, 120 and three fuses. The power-on switch is electrically connected to the "hot" electrical supply through a fuse. The cancel switch 112 is a normally closed, momentarily opened proximity switch mechanically activated when control lever 88 is placed in lever position 4. One contact of switch 112 is connected to the power-on switch 92, and a second contact is connected to the first relay 116, which in turn is connected to ground. When the power-on switch is closed and power supplied to the circuit, normally closed cancel switch 112 supplies power to and energizes the first relay 116. A set of first relay contacts 116-1 connects the power-on switch 92 to the commit switch 114. Because cancel switch 112 is normally closed, and the first relay 116 normally energized, the first relay contacts 116-1 normally supply power to the commit switch 114, which in turn is connected to the second relay 118, which in turn is connected to ground. Commit switch 114 is a normally opened, momentary contact, proximity-type switch mechanically actuated by the control lever 88 when the lever is placed in lever position 3. Second relay 118 actuates two sets of contacts 118-1, 118-2. The first contacts 118-1 operate to "latch-in" relay 118 by closing a circuit around commit switch 114 when relay 118 is energized. Thus, when commit switch 114 is released, second relay 118 remains energized through the first latch-in contacts 118-1. When energized, second relay 118 also actuates contacts 118-2, which connect the "commit-to-launch or recover" light 96 to the power-on switch 92.

The power-on switch 92 is connected to switch 104 through switch 114 when switch 114 is actuated. Switch 104 actuates the third relay 120, which in turn is connected to ground. Switch 104 is a normally opened, momentary contact, proximity-type switch which is mechanically closed when a substantially slack condition exists in the cable 14. The third relay 120 comprises two sets of contacts 120-1, 120-2. The contacts 120-1 of the third relay 120 operate to "latch-in" the third relay by closing a circuit around switch 104 when relay 120 is energized. One of the contacts 120-1 is electrically connected to the conductor between the second relay 118 and the first latch-in contacts 118-1 of the second relay. The contacts 120-1 when closed energize relay 120 from the circuit to relay 118. Thus, when both the second relay 118 and third relay 120 are energized, the switch 104 of the tension sensor 74 can return to its normally open position without de-energizing the third relay 120. The second set of contacts 120-2 actuated by the third relay 120 operate to energize the solenoid 72 of the mode selector valve 70.

A fuse connects the power-on switch 92 to the power-on light 94, which in turn is connected to ground.

When the second and third relays 118, 120 are energized, and the system is in the constant tension mode, cancel switch 112 is used to return the system to the normal hoisting mode. The cancel switch 112 is normally closed, energizing the first relay 116 which supplies power to the second and third relays 118, 120. When the cancel switch 112 is momentarily opened by moving the control lever 88 to lever position 4, the first relay 116 is de-energized, which opens the relay contacts 116-1, cutting power to the second and third relays 118, 120. This causes the solenoid 72 of the mode selector valve 70 to be de-energized, returning the valve to its normal state, as shown in FIG. 2, which returns the system to the normal hoisting mode.

DETAILED OPERATION

Hoisting and Lowering Function

The normal hoisting and lowering function is achieved by using the main control valve while the mode selector valve 40 is in the position shown in FIG. 2. When the selector valve is in this position, the final drive brake 58 and auxiliary motor 64 are not pressurized and the brake 58 is fully engaged and holds the internal ring gear 52 stationary and the maximum rated load for the hoisting system 16 can be raised and lowered in the normal manner.

Constant Tension Function

Constant tension is achieved by energizing the mode selector valve 40 to direct the fluid flow to the auxiliary motor 64 through the flow control 82. This pressurizes the auxiliary motor to drive it in a hoisting direction and at the same time pressure releases the brake 58, allowing the internal ring gear 52 to rotate.

When the mode selector valve 40 is actuated to supply fluid to the auxiliary motor 64, it isolates the main control valve 48 from pump pressure and the sun gear 50 is held stationary by the primary brake 42.

The pilot-operated pressure relief valve 84, in conjunction with cam operated relief valve 86, is used to set the auxiliary motor pressure to provide the required cable tension. In this system, the auxiliary motor 64 is pressurized for hoisting only and as the lifeboat rises on a wave, the drum 30 winds the cable 14 onto the drum under tension until the boat reaches the crest of the wave. As the lifeboat goes down with the wave, it pulls the cable off the drum 30. This action drives the internal ring gear 52 which in turn drives the auxiliary motor 64 as a pump against the relief valve pressure.

When the boat rises with a wave, the speed of the auxiliary motor 64 is dictated by the speed of the drum 30. The volume of oil supplied by the flow control 82 is always greater than the volume of oil required by the auxiliary motor, even for the fastest wave motion. The extra volume of oil that does not go through the auxiliary motor 64 will by-pass through the pilot-operated relief valve 84. The pressure at the final drive brake 58 is set by the relief valve 80 which is set for a pressure that is approximately 100 psi greater than the maximum pressure setting of pilot-operated relief valve.

Winch Operation

In the normal hoisting mode, lowering is achieved by moving the control lever 88 from position 1 to position 2 and hoisting is achieved by moving the lever from position 1 through position 4 to position 5.

In the constant tension mode, when the control lever 88 is moved from position 1 to position 2 it rotates a cam and decreases the pressure setting on the cam operated relief valve 84. This decreases the pressure on the auxiliary motor 64 to zero when position 2 is reached. Conversely, when the control lever 88 is moved from position 2 to position 1 the pressure on the auxiliary motor 64 is increased to the maximum setting when position 1 is reached.

When the control lever 88 is moved to position 3, which is the "commit to launch" position, the yellow "ready-to-launch or recover" light 96 turns on and the lever closes the commit switch 114 that prepares the electrical circuit for the activation of the switch 104 on the cable tension sensor 74 at the top of the davit 12. Then when the switch 104 is actuated, the solenoid mode selector valve 40 directs the fluid supply to the auxiliary drive 34 and provides constant tension.

After the lever 88 has been moved to position 3 and the yellow "ready-to-launch or recover" light 96 is on, the lever does not require to be held in position 3 until the roller assembly switch 104 of the cable tension sensor 74 is closed, because the "latch-in" relay contacts 118-1 bypass the commit switch 114. The lever can be returned to position 2, the yellow light 96 will stay on and the constant tension will be activated by the roller assembly switch 104.

When the control lever 88 is moved from position 1 to position 4, it opens the cancel switch that cancels the yellow "ready to launch or recover" light 96 if position 3 "commit to launch" was previously selected. This also cancels the constant tension mode by disengaging the solenoid-actuated mode selector valve 40, and directs the fluid flow to the main control valve 48 for normal hoisting and lowering operation.

When the control lever 88 is moved from position 2 to position 3 and from position 1 to position 4 a positive effort is required on the control lever to overcome a detent and spring. This prevents unintentional movement of the control lever 88 into these positions.

Boat Lowering Operation

The following procedure is used for lowering a lifeboat into the sea when the size of the waves in rough weather does not permit the lifeboat to be lowered directly into the sea with safety.

(1) In preparation for lowering, the power switch 92 is turned "on," lighting the green "power-on" light 94. The mode selector valve 40 is positioned as shown in FIG. 2 (not energized) to direct the fluid flow to the manual control valve 48.

(2) The control lever 88 is used to position the boat in preparation for launching by moving the lever between positions 1 and 2 for lowering and positions 4 and 5 for hoisting.

(3) The boat crew starts the boat motor in preparation for the boat entering the water.

(4) To launch the boat the control lever 88 is moved from position 1 through position 2 to position 3 which is the "commit to launch" position. This will turn on the yellow "ready to launch or recover" light 96. As soon as the boat makes contact with the water the cable becomes substantially slack, the roller assembly switch 104 closes, activating the mode selector valve solenoid 72 and puts the system into the constant tension mode, dropping the boat onto the waves with no tension on the cable because the cam operated relief valve 86 is at minimum setting. This allows the boat crew to release the cable 14 immediately and move away from the ship.

(5) When the boat has been released from the cable 14 the control lever 88 must be moved quickly from position 2 through position 1 to position 4. This opens the cancel switch 112 at position 4 and cancels the constant tension mode and the empty hook 20 and cable 14 can then be raised by moving the control lever 88 towards position 5 for hoisting.

Boat Hoisting Operation (1) In preparation for hoisting the boat 2, the power on switch 92 is "on" lighting the green "power-on" light 94.

(2) The boat is brought alongside the platform or ship 4 under the davit 12.

(3) The cable 14 is lowered by moving the control lever 88 into position 2 until the hook 20 reaches the boat. The control lever 88 is then moved to position 3 and since the cable 14 has no load on it, the roller assembly switch 104 is already closed and the commit switch 114 in the control panel 90 at position 3 activates the mode selector valve solenoid 72 to put the system into the constant tension mode. The yellow "ready-to-launch or recover" light 96 turns on.

(4) The boat crew can now pull cable 14 from the drum 30 by hand and connect the hook 20 to the boat. The control lever 88 is then moved slowly from position 2 toward position 1 This gradually increases the pilot-operated relief valve 84 pressure to pick up the slack cable 14. As soon as all slack is removed in conjunction with the wave action the control lever 88 is moved quickly to position 1. This increases the relief valve 84 pressure to its maximum setting providing full constant tension on the cable 14. The boat then rises and falls on the waves with a taut cable 14 while the boat is positioned directly under the davit 12 in preparation for hoisting.

(5) As the boat reaches the crest of a wave, the control lever 88 is moved from position 1 through position 4 directly to position 5. This action opens the cancel switch 112 at position 4 which de-energizes the mode selector valve solenoid 72 returning the mode selector valve 40 to the position shown on FIG. 2 directing the fluid flow to the main control valve 48 which has been moved to the full hoist position. The boat is then hoisted clear of the water, the boat motor is shut off and the boat is hoisted to a position where the crew can unload.

I claim:

1. A constant tension hoisting system having a single-lever control for a winch having a drive torque variable from minimum to maximum in a constant tension mode and that is operable to be switched between a normal mode and a constant tension mode for raising and lowering an object supported by a cable on the winch between a relatively stable platform and a surface undergoing vertical wave motion relative to the platform, said lever control being capable of switching the system between the normal and the constant tension mode, comprising:

a single, manually actuated control lever means positionable for controlling the winch for (1) hoisting and lowering in the normal mode, (2) varying the cable tension of the constant tension mode, and (3) activating a constant tension mode selection circuit to allow switching between the normal mode and the constant tension mode;

said control lever being positionable into a commit-to-constant-tension position when activating the constant tension mode selection circuit;

means responsive to the control lever being placed in the commit-to-constant-tension position for activating the constant tension mode selection circuit to allow switching between the normal mode and the constant tension mode; and means responsive to a change to minimum cable tension for automatically switching the winch from the normal mode to the constant tension mode when the constant tension mode selection circuit is activated.

2. The constant tension hoisting system of claim 1, said control lever means being positionable into a neutral position, a minimum cable tension in constant tension mode position and said commit-to-constant-tension position, and wherein the control lever cannot be moved from the neutral position to the commit-to-constant-tension position without being placed in the minimum cable tension in constant tension mode position so that the drive torque is reduced to provide minimum tension in the cable when the automatic switching from the normal mode to the constant tension mode occurs.

3. The single-lever control of claim 1 wherein the means for automatically switching the winch from the normal mode to the constant tension mode includes means for sensing a low tension condition in the cable and initiates switching of the hoisting system from the normal mode to the constant tension mode at the moment when a substantially low tension condition is sensed in a cable of the hoisting system.

4. A single lever control for a winch that is operable to be switched between a normal mode and a constant tension mode for raising and lowering an object supported by a cable on the winch between a relatively stable platform and a surface undergoing vertical wave motion relative to the platform, comprising:

a single hand lever control means for (1) providing hoist, lower and neutral conditions in a normal operating mode, (2) providing minimum and maximum tension conditions in a constant tension mode, and (3) switching between said normal and constant tension modes.

5. The control of claim 4, said control having an operating handle and a guide slot, the guide slot defining various operating positions for the handle, said slot having a first location for providing a neutral condition in the normal operating mode, a second location for providing a commit-to-constant-tension condition, a third location for a cancel constant tension condition, and a fourth location for providing hoisting in the normal mode.

6. The control of claim 5, said control slot also including a fifth location for providing lowering in the normal mode and minimum tension in the constant tension mode.

7. The control of claim 6, said slot fifth location lying sidewise adjacent said slot second location.

8. The control of claim 5, said slot third location lying sidewise adjacent said slot first location.

* * * * *